US012709970B2

(12) United States Patent
Al Abdrabalnabi et al.

(10) Patent No.: US 12,709,970 B2
(45) Date of Patent: Aug. 18, 2026

(54) SYSTEMS AND METHODS FOR WELL PLACEMENT IN STABLE IN-SITU STRESS FOR HORIZONAL DRILLING

(71) Applicant: Saudi Arabian Oil Company, Dhahran (SA)

(72) Inventors: Hussain Al Abdrabalnabi, Dhahran (SA); Mohammad Asiri, Saihat (SA)

(73) Assignee: Saudi Arabian Oil Company, Dhahran (SA)

( * ) Notice: Subject to any disclaimer, the term of this patent is extended or adjusted under 35 U.S.C. 154(b) by 542 days.

(21) Appl. No.: 18/329,920

(22) Filed: Jun. 6, 2023

(65) Prior Publication Data

US 2024/0410264 A1 Dec. 12, 2024

(51) Int. Cl.

| | |
|---|---|
| ***E21B 44/00*** | (2006.01) |
| ***E21B 7/04*** | (2006.01) |
| ***E21B 49/00*** | (2006.01) |

(52) U.S. Cl.

CPC ..... *E21B 44/00* (2013.01); *E21B 7/04* (2013.01); *E21B 49/006* (2013.01); *E21B 2200/20* (2020.05)

(58) Field of Classification Search

CPC ..... E21B 7/04

See application file for complete search history.

(56) References Cited

U.S. PATENT DOCUMENTS

| | | | |
|---|---|---|---|
| 5,115,872 | A | 5/1992 | Brunet et al. |
| 8,527,248 | B2 | 9/2013 | Thambynayagam et al. |
| 8,534,380 | B2 | 9/2013 | Sheppard et al. |
| 8,960,326 | B2 | 2/2015 | Williams |

(Continued)

FOREIGN PATENT DOCUMENTS

| | | |
|---|---|---|
| CA | 2509585 | 11/2010 |
| CA | 2886327 | 7/2018 |
| CN | 107676038 | 2/2018 |

OTHER PUBLICATIONS

Guizada et al., "Application of Underbalanced Coiled Tubing Drilling Technology to Enhance Gas Production in Deep Carbonate Reservoirs," presented at the Abu Dhabi International Petroleum Exhibition and Conference, Abu Dhabi, UAE, Nov. 12, 2018, 8 pages.

(Continued)

*Primary Examiner* — Oluseye Iwarere

(74) *Attorney, Agent, or Firm* — Fish & Richardson P.C.

(57) ABSTRACT

Among other things, methods and systems are described for drilling a target wellbore in a hydrocarbon bearing (HCB) formation. A method involves selecting a plurality of offset wells in proximity of a location of the target wellbore, where the plurality of offset wells are in different directions with respect to the location; for each offset well: generating a porosity and in-situ stress profile for a first sub-formation of the HCB formation; and selecting, based on the porosity and in-situ stress profile, stable-stress window in the first sub-formation; integrating the stable-stress windows from the plurality of offset wells with seismic data associated with the first sub-formation; generating, based on the integrated data, a three-dimensional (3D) stress stable horizon in the first sub-formation; and generating, based on the 3D stress stable horizon, a drilling trajectory for a drilling operation in the first sub-formation.

20 Claims, 10 Drawing Sheets

(56) References Cited

U.S. PATENT DOCUMENTS

| | | | | |
|---|---|---|---|---|
| 9,284,782 | B2 | 3/2016 | Downton | |
| 9,482,775 | B2 | 11/2016 | Wu et al. | |
| 9,512,707 | B1 | 12/2016 | Bermudez Martinez | |
| 11,261,720 | B2 | 3/2022 | Aziz et al. | |
| 2002/0088648 | A1 | 7/2002 | Krueger et al. | |
| 2004/0127337 | A1 | 7/2004 | Nashner | |
| 2010/0155142 | A1* | 6/2010 | Thambynayagam | E21B 44/00 175/61 |
| 2012/0042069 | A1 | 2/2012 | Hatasaki et al. | |
| 2012/0046868 | A1 | 2/2012 | Tchakarov et al. | |
| 2012/0325462 | A1* | 12/2012 | Roussel | G01V 1/306 166/250.1 |
| 2013/0140088 | A1* | 6/2013 | Williams | E21B 7/06 175/45 |
| 2018/0371883 | A1* | 12/2018 | Enkababian | G01V 5/12 |
| 2019/0128105 | A1 | 5/2019 | Al-Mulhem | |
| 2020/0158907 | A1* | 5/2020 | Li | E21B 41/00 |
| 2021/0256183 | A1* | 8/2021 | Zhang | E21B 43/26 |
| 2021/0357777 | A1 | 11/2021 | Moreno Sierra et al. | |
| 2024/0076980 | A1* | 3/2024 | Yong | G01V 20/00 |

OTHER PUBLICATIONS

Larki et al., "Feasibility study of underbalanced drilling using geomechanical parameters and finite element method," Journal of Petroleum Exploration and Production Technology, Sep. 2022, 13:407-426, 20 pages.

McLellan et al., "Borehole Stability Analysis for Underbalanced Drilling," Journal of Canadian Petroleum Technology, May 2001, 40(5):31-38, 8 pages.

Swire et al., "Steering with the Multifunction LWD Tool Achieves Optimum Results in High Structural Uncertainty Field in Egypt," presented at the SPE Middle East Oil and Gas Show and Conference, Manama, Bahrain, Mar. 10-13, 2013, 7 pages.

* cited by examiner

SYSTEMS AND METHODS FOR WELL PLACEMENT IN STABLE IN-SITU STRESS FOR HORIZONAL DRILLING

TECHNICAL FIELD This description relates to systems and methods for drilling operations.

BACKGROUND

Oil and gas wells in tight reservoirs are stimulated by hydraulic fracturing, which is a field practice to enhance production from otherwise uneconomic wells. Hydraulic fracturing operations can be applied in open-hole or cased-hole recovery wells. In general, fracturing processes are carried out using completions that will isolate part of a horizontal well section, perforate casing if the well is cased, and then pump the fracturing fluid to initiate and propagate fractures in one or more lateral extensions. In some cases, tight formations have greater stress values, and rock with greater compressive strength values creates difficulty propagating fractures using hydraulic fracturing. As a result, drillers sometimes use multilateral wells to compensate and maximize the surface area that connects a recovery well to a hydrocarbon-bearing reservoir by drilling several laterals from the main vertical well using underbalanced coiled tubing directional drilling. This technique involves running a coiled tubing string into the formation while keeping the pressure inside the tubing string lower than the formation pressure.

SUMMARY

This disclosure describes systems and methods that achieve improvements to underbalanced coiled tubing directional drilling (UBCTDD) in hydrocarbon-bearing (HCB) formations. As described in this disclosure, the systems and methods consider in-situ stress variation across an HCB formation as an indicator of failure of UBCTDD in that formation. The systems and methods prioritize wellbore stability over porosity navigation (used in the existing systems), classify stress contrast as a source of wellbore instability, and provide systematic solutions to prevent penetrating high-stress contrast sections in HCB formations.

One aspect of the subject matter described in this specification may be embodied in a method implemented using a system for drilling a target wellbore in a hydrocarbon bearing (HCB) formation. The method involves selecting a plurality of offset wells in proximity of a location of the target wellbore, where the plurality of offset wells are in different directions with respect to the location; for each offset well: generating a porosity and in-situ stress profile for a first sub-formation of the HCB formation; and selecting, based on the porosity and in-situ stress profile, stable-stress window in the first sub-formation; integrating the stable-stress windows from the plurality of offset wells with seismic data associated with the first sub-formation; generating, based on the integrated data, a three-dimensional (3D) stress stable horizon in the first sub-formation; and generating, based on the 3D stress stable horizon, a drilling trajectory for a drilling operation in the first sub-formation.

The previously described implementation is implementable using a computer-implemented method; a non-transitory, computer-readable medium storing computer-readable instructions to perform the computer-implemented method; and a computer system including a computer memory interoperably coupled with a hardware processor configured to perform the computer-implemented method or the instructions stored on the non-transitory, computer-readable medium. These and other embodiments may each optionally include one or more of the following features.

In some implementations, the method further involves during the drilling operation, controlling a drilling system to drill according to the drilling trajectory to create the target wellbore.

In some implementations, the method further involves during the drilling operation, using real-time data to verify a predicted location of the 3D stress stable horizon; and in response to determining that the predicted location of the 3D stress stable horizon is inaccurate, adjusting the predicted location of the 3D stress stable horizon based on the real-time data.

In some implementations, the real-time data is measurement-while-drilling (MWD) data.

In some implementations, generating the porosity and in-situ stress profile for the first sub-formation involves defining, using corresponding open-hole logs for the offset wellbore, sub-formation tops for a plurality of sub-formations in the HCB formation; selecting, based on respective porosities of the plurality of sub-formations, the first sub-formation from the plurality of sub-formations; and generating, based on porosity and stress data for the first sub-formation, the porosity and in-situ stress profile for the first sub-formation.

In some implementations, selecting, based on respective porosities of the plurality of sub-formations, the first sub-formation from the plurality of sub-formations involves determining that the respective porosity of the first sub-formation meets a target porosity for the HCB formation.

In some implementations, selecting, based on the porosity and in-situ stress profile, the stable-stress window in the first sub-formation involves identifying, based on the porosity and in-situ stress profile, high-stress contrast regions in the first sub-formation; and defining, based on the high-stress contrast regions, upper and lower boundaries of the stable-stress window.

In some implementations, integrating the stable-stress windows from the plurality of offset wells with the seismic data associated with the first sub-formation involves determining respective thicknesses of the stable-stress windows; interpolating the respective thicknesses of the stable-stress windows between the plurality of offset wells; and tying the interpolated thicknesses with the seismic data to account for formation dipping.

In some implementations, the drilling operation is underbalanced coiled tubing directional drilling (UBCTDD).

Existing directional drilling systems do not consider in-situ stress variation within an HCB target. Rather, existing systems use measurement-while-drilling (MWD) and porosity-based geo-steering techniques. In these techniques, the geo-steering decision making is influenced by drilling cuttings results that are used to navigate the HCB formation based on the visual porosity of the cuttings. Such practices lead to reactive geo-steering decisions. For instance, when signs of wellbore instability occur while penetrating high in-situ stress, the geo-steering systems react by changing/maneuvering up or down without any reference or approach for predicting where the formation is most stable. This results in shorter laterals than planned due to failure of drilling when wellbore instability inevitably occurs. Specifically, these systems expose UBCTDD to a considerable risk of penetrating through stress contrast layers, which increases the risk of encountering wellbore instability. This can lead to prematurely aborting a drilling operation and failing to meet a planned reservoir contact. As a result, additional resources (e.g., time, human capital, and economic capital) are required to sidetrack and drill more laterals to meet the planned reservoir contact.

Implementations of the subject matter described in this specification can be implemented to realize one or more of the following advantages. The disclosed methods and systems proactively mitigate wellbore instability. In particular, the disclosed systems and methods mitigate wellbore instability in UBCTDD operations without altering or adjusting underbalance conditions (e.g., without adjusting Equivalent Circulating Density [ECD] or bottom-hole pressure). Compared to existing systems, the disclosed systems and methods are more efficient and economical in terms of drilling time and capital allocated to drilling. Further, unlike existing systems, the disclosed systems and methods can meet the planned reservoir contact. The disclosed systems and methods optimize the number of drilling attempts needed to meet the required reservoir contact to only one lateral drilling operation. In particular, the disclosed systems and methods generate a pre-determined safe window that supports geosteering to navigate only within a proactively identified window. In existing systems, however, more time and money resources are required to meet the planned reservoir contact (as the initial lateral concludes early without meeting the planned reservoir contact).

The details of one or more embodiments of these systems and methods are set forth in the accompanying drawings and description below. Other features, objects, and advantages of these systems and methods will be apparent from the description, drawings, and claims.

BRIEF DESCRIPTION OF THE DRAWINGS

Like reference numbers and designations in the various drawings indicate like elements.

DETAILED DESCRIPTION

This disclosure describes systems and methods for underbalanced coiled tubing directional drilling (UBCTDD) in hydrocarbon-bearing (HCB) formations. In one implementation, a drilling system determines a stable in-situ stress horizon (stable-stress horizon) for a target wellbore in an HCB formation. The stable-stress horizon is defined by a uniform stress within the HCB formation that allows UBCTDD to occur without encountering wellbore instability issues. To generate the stable-stress horizon, the drilling system uses data from offset wells in the HCB formation, formation mechanical properties, geological, and/or geophysical data to generate stable in-situ stress windows for each offset well. The drilling system uses the stable in-situ stress windows to generate the stable-stress horizon. The drilling system uses the stable-stress horizon to improve the target well placement. By using the stable-stress horizon for well placement, the drilling system avoids drilling through stress contrast sections where the risk of getting stuck due to wellbore instability increases substantially.

As described in this disclosure, the improvements achieved by the disclosed systems and methods include the ability to: (1) identify upper and lower "no-go" in-situ stress boundaries to safeguard the lateral placement from penetrating stress contrast sections above or below a target drilling area, (2) drill strategically in areas where the error of exiting the target drilling window is reduced, and (3) mitigate wellbore instability issues in UBCTDD. As such, the disclosed systems and methods mitigate the existing wellbore instability challenges in using UBCTDD in HCB formations. Unlike existing systems, the disclosed systems and methods prioritize wellbore stability over porosity navigation, classify stress contrast as the source of potential wellbore instability, and provide a systematic solution to prevent penetrating high-stress contrast sections in a formation. These features enhance UBCTDD operations.

Figure 1:
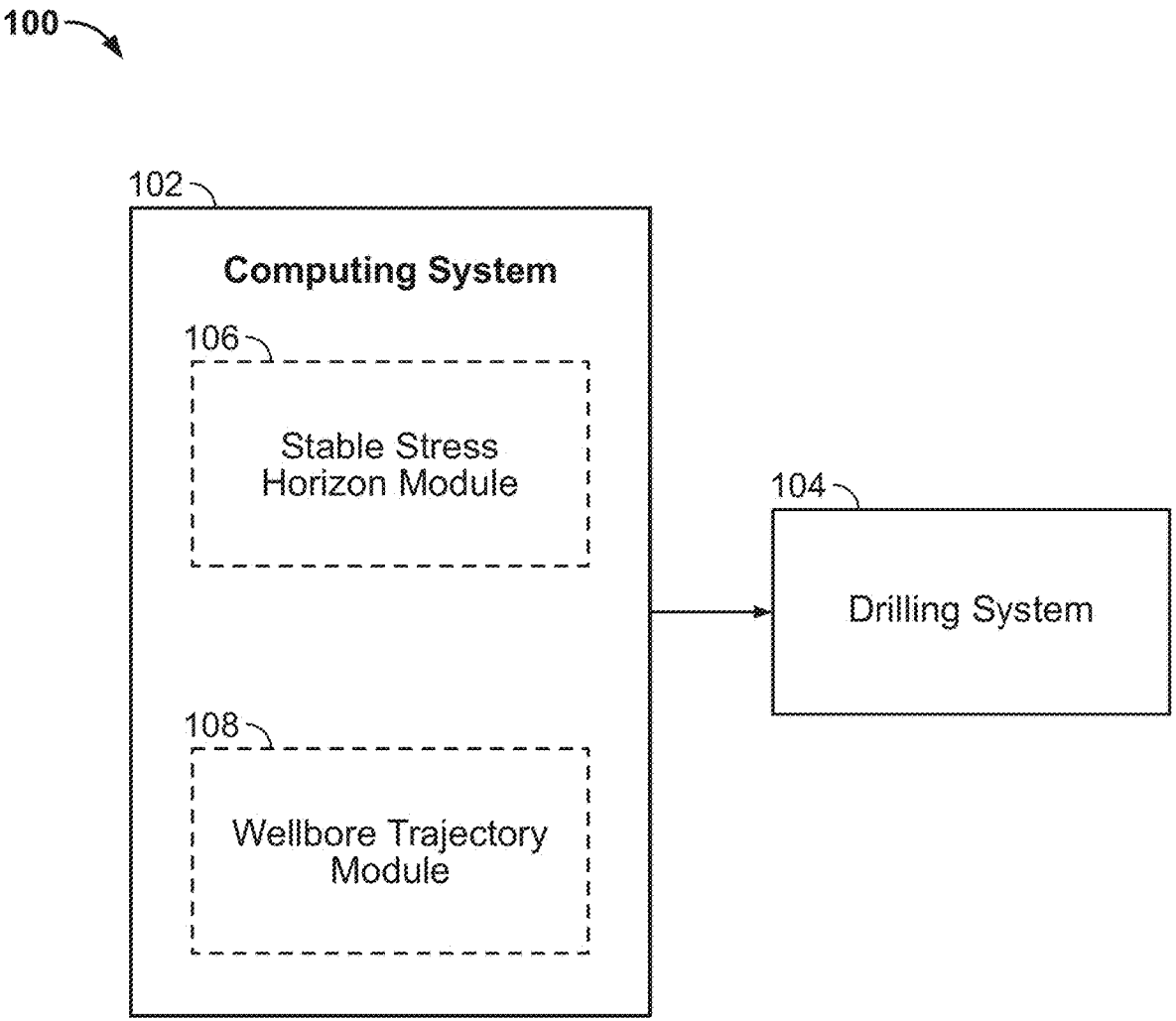
FIG. 1 illustrates an example underbalanced coiled tubing directional drilling system, according to some implementations.

FIG. 1 illustrates an example UBCTDD system 100, according to some implementations. The UBCTDD system 100 can be used for drilling operations in HCB formations. As shown in FIG. 1, the UBCTDD system 100 includes a computing system 102 and a drilling system 104. The computing system 102 can be implemented using a computer system, such as the computer system 800 of FIG. 8. The drilling system 104 can be (partially) implemented using the example rig system 900 of FIG. 9. Note that the UBCTDD system 100 is shown for illustration purposes only, as the UBCTDD system 100 can include additional components or have one or more components removed without departing from the scope of the disclosure. Further, note that the various components of the UBCTDD system 100 can be arranged or connected in any manner.

In some implementations, the computing system 102 includes a stable-stress horizon module 106 and a wellbore trajectory module 108. The stable-stress horizon module 106 is configured to perform a workflow for generating a stable-stress horizon for a target wellbore in an HCB formation. The wellbore trajectory module 108 is configured to generate, based on the stable-stress horizon, a drilling trajectory for the target wellbore. The computing system 102 is also configured to control the drilling system 104 based on the drilling trajectory.

Figure 2:
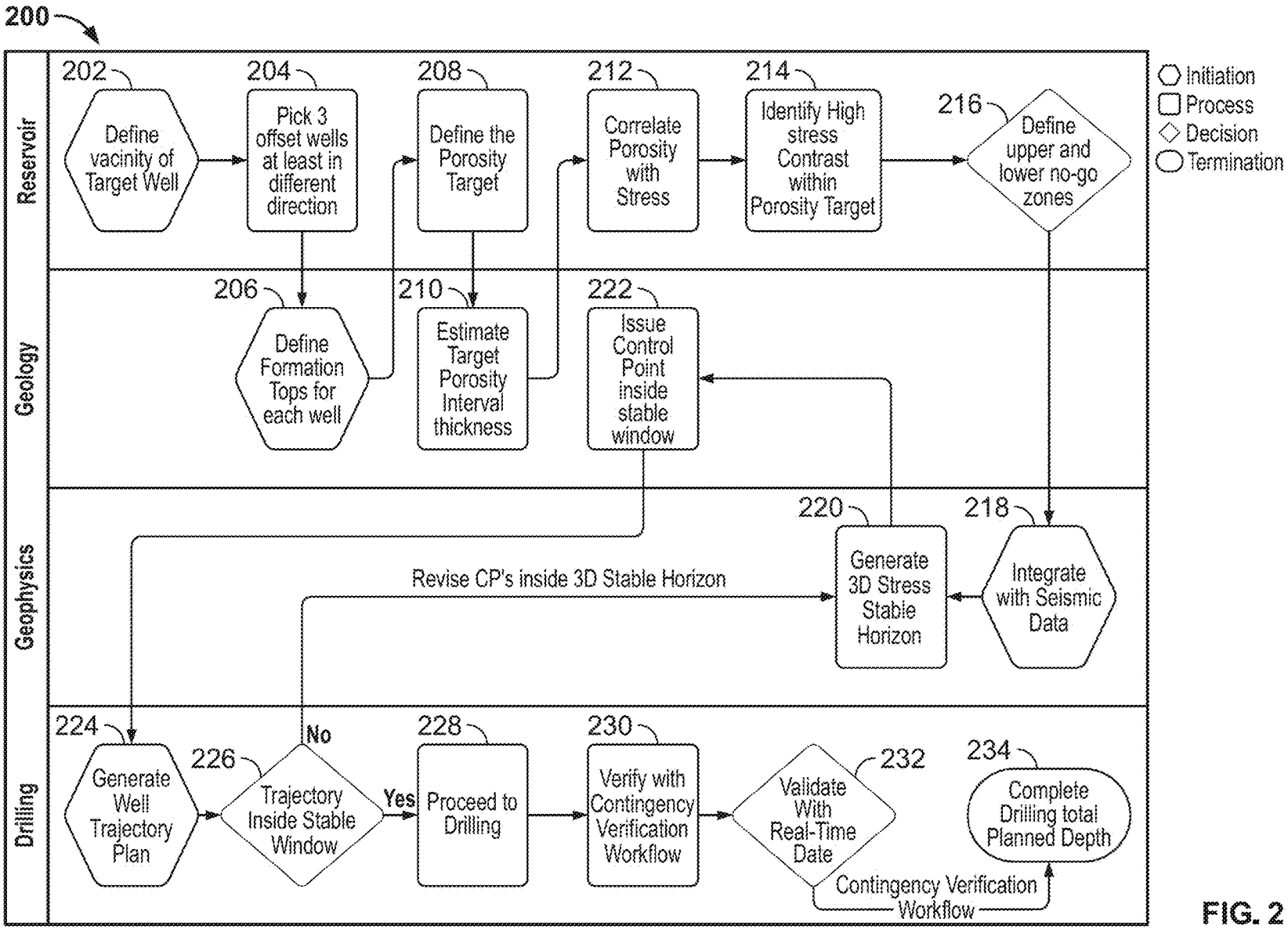
FIG. 2 illustrates an example underbalanced coiled tubing directional drilling workflow, according to some implementations.

FIG. 2 illustrates an example UBCTDD workflow 200, according to some implementations. The UBCTDD workflow 200 can be performed by the UBCTDD system 100 to drill a target wellbore in an HCB formation. In particular, the computing system 102 performs the UBCTDD workflow 200 to generate a stable-stress horizon for the target wellbore. The computing system 102 also performs the UBCTDD workflow 200 to generate a drilling trajectory for drilling the target wellbore. Further, the computing system 102 also performs the UBCTDD workflow 200 to control the drilling system 104 to drill the wellbore based on the drilling trajectory. As shown in FIG. 2, some steps of the UBCTDD workflow 200 are related to the reservoir, some steps are related to geology, some steps are related to geophysics, and some steps are related to drilling.

The UBCTDD workflow 200 starts at step 202. At this step, the computing system 102 determines a location of the target wellbore. The computing system 102 can determine the location of the target wellbore autonomously or based on user input. In an example, the computing system 102 determines the location of the target wellbore based on a reservoir location (e.g., hydrocarbon reserves limits) in the HCB formation. More specifically, the computing system 102 can determine the location based on data from existing wells (e.g., offset wells) in the reservoir, such as open-hole logs, flowback rate, and flowing wellhead pressure.

At step 204, the computing system 102 picks a plurality of offset wells, in different directions, that are penetrating the HBC formation. The plurality of offset wells can be located within a defined vicinity (e.g., a predetermined distance) of the target wellbore. In one example, the plurality of offset wells are at least three offset wells in three different directions. The following disclosure describes the UBCTDD workflow 200 using the example of three offset wells in three different directions, but other numbers of offset wells and directions are also possible.

At step 204, the computing system 102 also obtains data associated with the offset wells and/or the HCB formation. The offset well data includes data measured in the offset wells, such as open-hole logs (e.g., neutron, density, sonic, and gamma ray wireline data). The data associated with the HCB formation includes formation mechanical properties, geological, and/or geophysical data, such as a porosity thickness of the HCB formation and regional formation tops (in the HCB formation) tied to seismic data.

Figure 3:
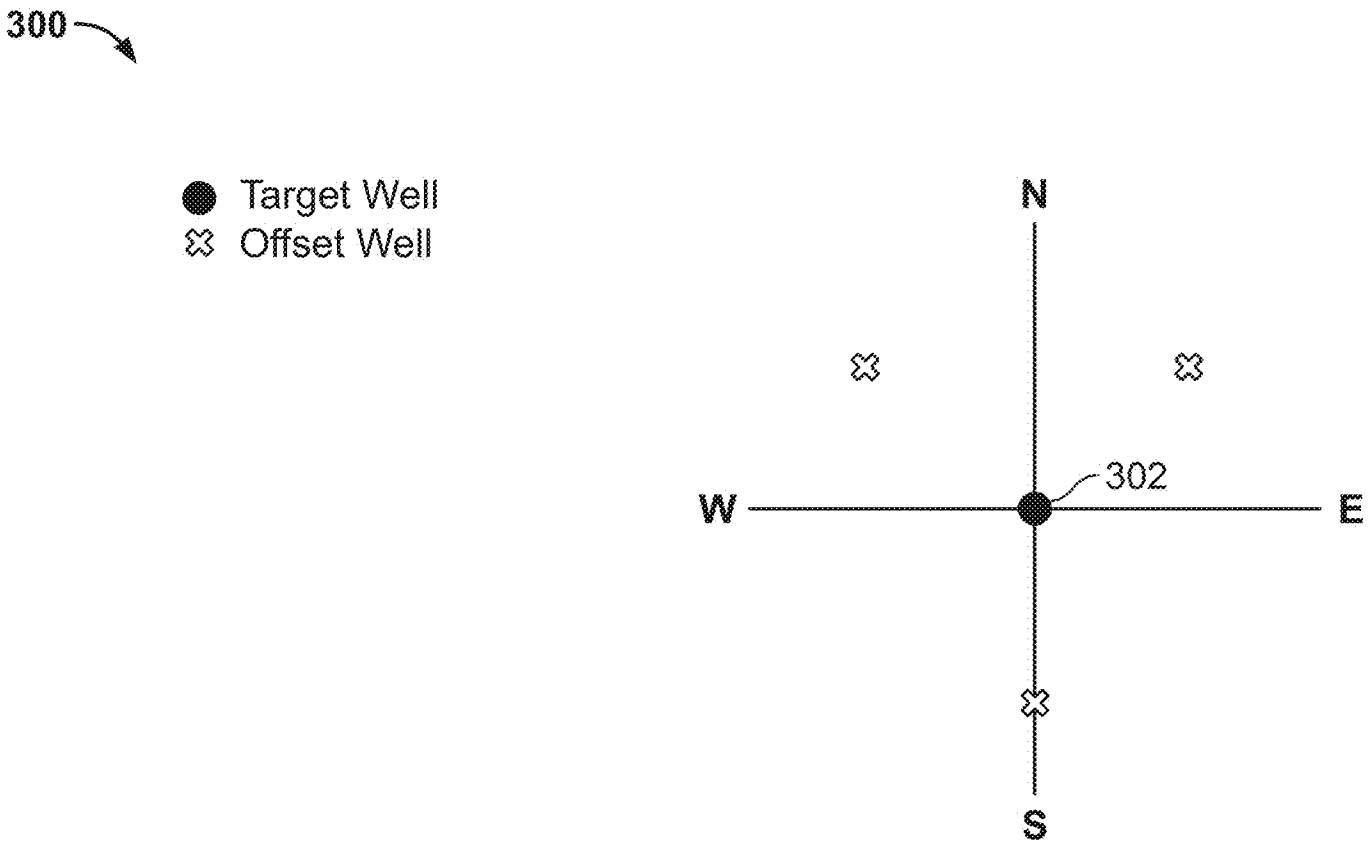
FIG. 3 illustrates example offset well locations with respect to a target wellbore, according to some implementations.

FIG. 3 illustrates example offset well locations 300 with respect to a target wellbore, according to some implementations. In the example of FIG. 3, the offset wells include three offset wells, where each well is located in a different direction with respect to the predicted location of a target wellbore 302.

Returning to FIG. 2, once the computing system 102 selects the offset wells, the computing system 102 performs a number of steps, either sequentially or simultaneously, for each of the offset wells. At step 206, for each offset well, the computing system 102 defines formation tops in the HCB formation. The computing system 102 can define the formation tops using the data obtained in step 204. At step 208, the computing system 102 defines a target porosity for the HCB formation. The target porosity is the threshold porosity that indicates the presence of a hydrocarbon reservoir in the HCB formation. In some implementations, the computing system 102 defines the target porosity from multiple porosity targets within the HCB formation. The computing system 102 uses historical data from the offset wells to determine the porosity depth, percentage, and potential target to flow hydrocarbon commercially. The historical data includes open-hole logs (e.g., neutron, density, sonic, and gamma ray wireline data), cased-hole logs (e.g., production logging technology), and well surface flowback parameters (e.g., hydrocarbon rate, flowing wellhead pressure, choke, chloride content) coming from completed specific porosity targets. Such data is used to assess and determine the best target porosity to flow commercially from multiple porosity targets.

At step 210, for each offset well, the computing system 102 estimates a target porosity interval thickness, e.g., using the data from the corresponding offset well. At step 212, for each offset well, the computing system 102 correlates the porosity data with stress data (e.g., in-situ stress data). The porosity data can be expressed as a porosity percentage and the in-situ stress data can be expressed in pounds-per-square inch/foot (psi/ft). More specifically, for each offset well, the computing system 102 generates a correlation of porosity and in-situ stress. The computing system 102 can plot the correlation for each offset well in a porosity and in-situ stress profile. In some examples, the computing system 102 plots the porosity and in-situ stress profile for a sub-formation in the HCB formation where the drilling is likely to occur. The computing system 102 can determine the sub-formation in which the drilling is likely to occur based on the porosity data. For instance, the porosity of a sub-formation being greater than the target porosity can indicate that drilling can occur in that sub-formation.

Figure 4A:
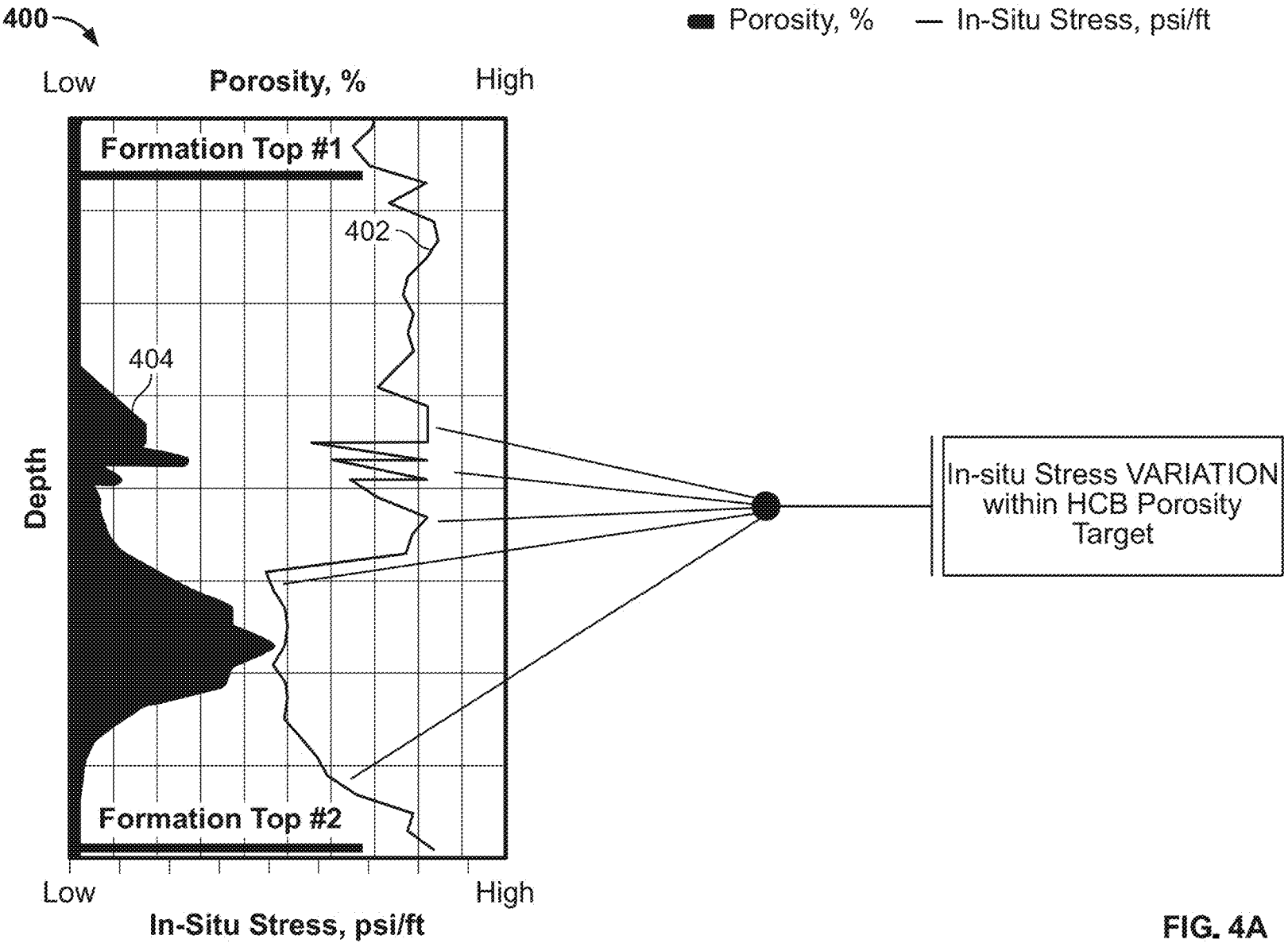
FIG. 4A illustrates an example a porosity and in-situ stress profile 400 for an offset well, according to some implementations.

FIG. 4A illustrates an example a porosity and in-situ stress profile 400 for an offset well, according to some implementations. The porosity and in-situ stress profile 400 is for a first sub-formation in the overall HCB formation. The porosity and in-situ stress profile 400 includes a plot 402 of in-situ stress data and a plot 404 of porosity data for a particular offset well. As shown by the plot 402, there is variation in the in-situ stress of the first sub-formation, even in regions where the target porosity is met.

Returning to FIG. 2, at step 214, the computing system 102 identifies high-stress contrast within the first sub-formation, e.g., in regions where the target porosity is met. At step 216, the computing system 102 defines, based on the high-stress contrast, upper and lower "no-go" zones in the first sub-formation. Defining the no-go boundaries reduces the drilling area target from the first sub-formation to the section with uniform/consistent in-situ stress. Thus, the enhanced drilling area target can be achieved by (1) correlating the porosity with in-situ stress acquired from mechanical properties of the HCB formation, (2) identifying significant stress contrast sections within the HCB porosity target, and (3) refraining the directional drilling from entering those sections by defining no-go upper and lower stress boundaries.

Figure 4B:
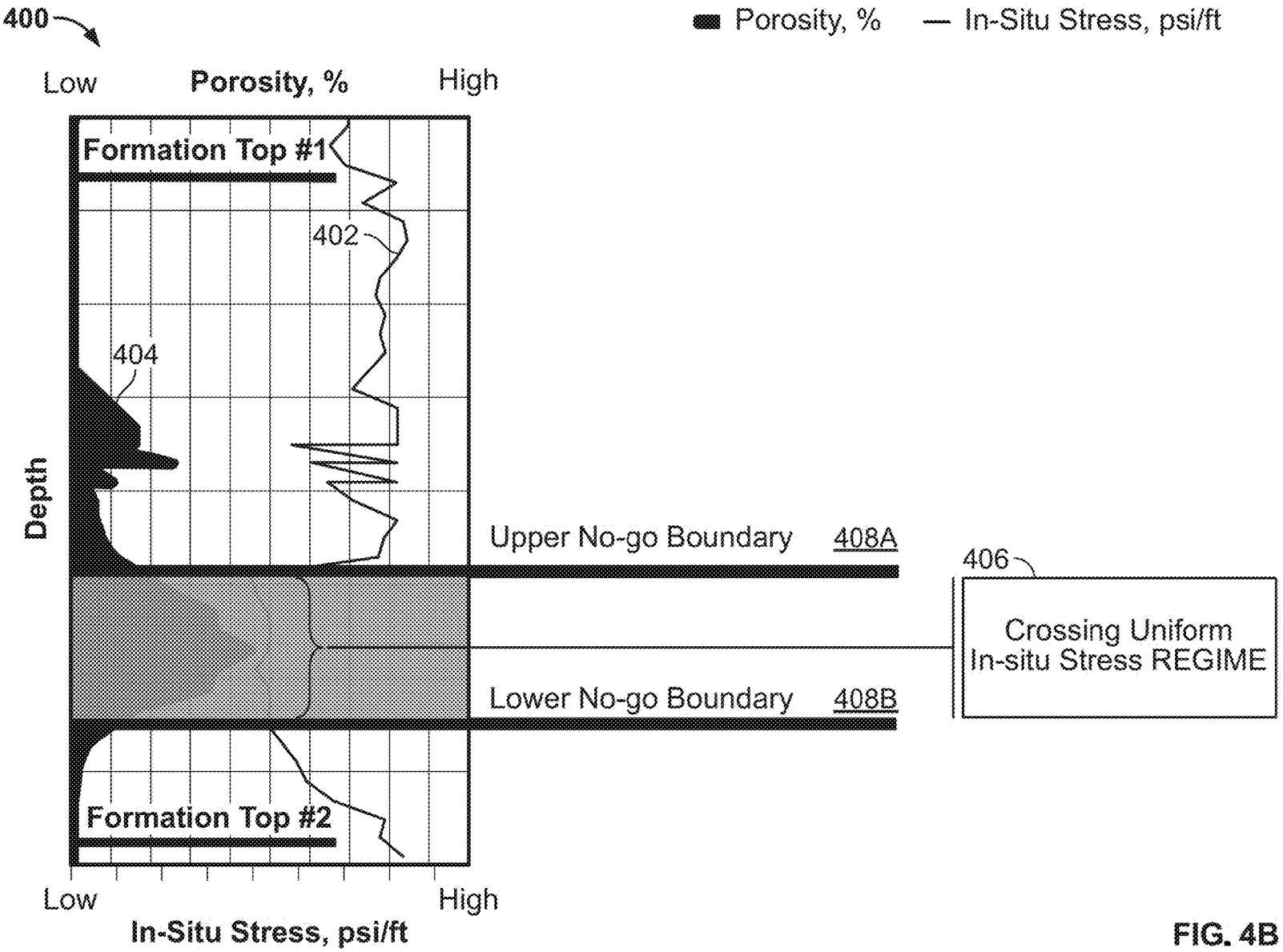
FIG. 4B illustrates an enhanced drilling area target selected using the porosity and in-situ stress profile of FIG. 4A, according to some implementations.

FIG. 4B illustrates an enhanced drilling area target selected using the porosity and in-situ stress profile 400, according to some implementations. As shown in FIG. 4B, a uniform in-situ stress regime 406 is identified in the plot 402. The edges of the uniform in-situ stress regime 406 are selected as an upper no-go boundary 408A and a lower no-go boundary 408B. The corresponding section of the first sub-formation is selected as the enhanced drilling area target in the HCB formation.

Returning to FIG. 2, at step 218, the computing system 102 integrates the porosity data for the offset wells with seismic data (e.g., 2D seismic data). More specifically, once the stable-stress window is identified in each data set (corresponding to each offset well), the thickness of the stable-stress windows is interpolated between the offset wells. The interpolated thickness is then tied with regional seismic horizons to account for formation dipping. In particular, the computing system 102 obtains seismic data that corresponds to the enhanced drilling area target (i.e., the section of the first formation between the "no-go" boundaries). The seismic data from each offset well can be used to generate 2D representation of the first formation. For example, the computing system 102 can use the 2D representation of the first formation to identify dips in the first formation. Doing so enables the computing system 102 to account for local dipping.

At step 220, the computing system 102 uses the seismic data from the offset wells to generate a 3D stable in-situ stress horizon (stable-stress horizon). Thus, the computing system 102 is configured to proactively refine the lateral placement by defining a geo-steering window where directional drilling maneuvers/changes are tolerable without exposing the lateral to considerable risk of penetrating sections with stress contrast.

At step 222, the computing system 102 generates a control point inside the stable-stress horizon. The control point serves as a reference point for well trajectory plans and during drilling operations. For example, the control point can serve as a target point for a well trajectory plan. At step 224, the computing system 102 generates a well trajectory plan, in part based on the selected control point. At step 226, the computing system 102 determines whether the generated trajectory is within the stable-stress horizon. If the generated trajectory is not within the stable-stress horizon, the computing system 102 returns to step 220. The computing system 102 then performs steps 220, 222, and/or 224 again until the generated trajectory is within the stable window. Once the generated trajectory is within the stable-stress horizon, the computing system 102 moves to step 228.

Figure 5:
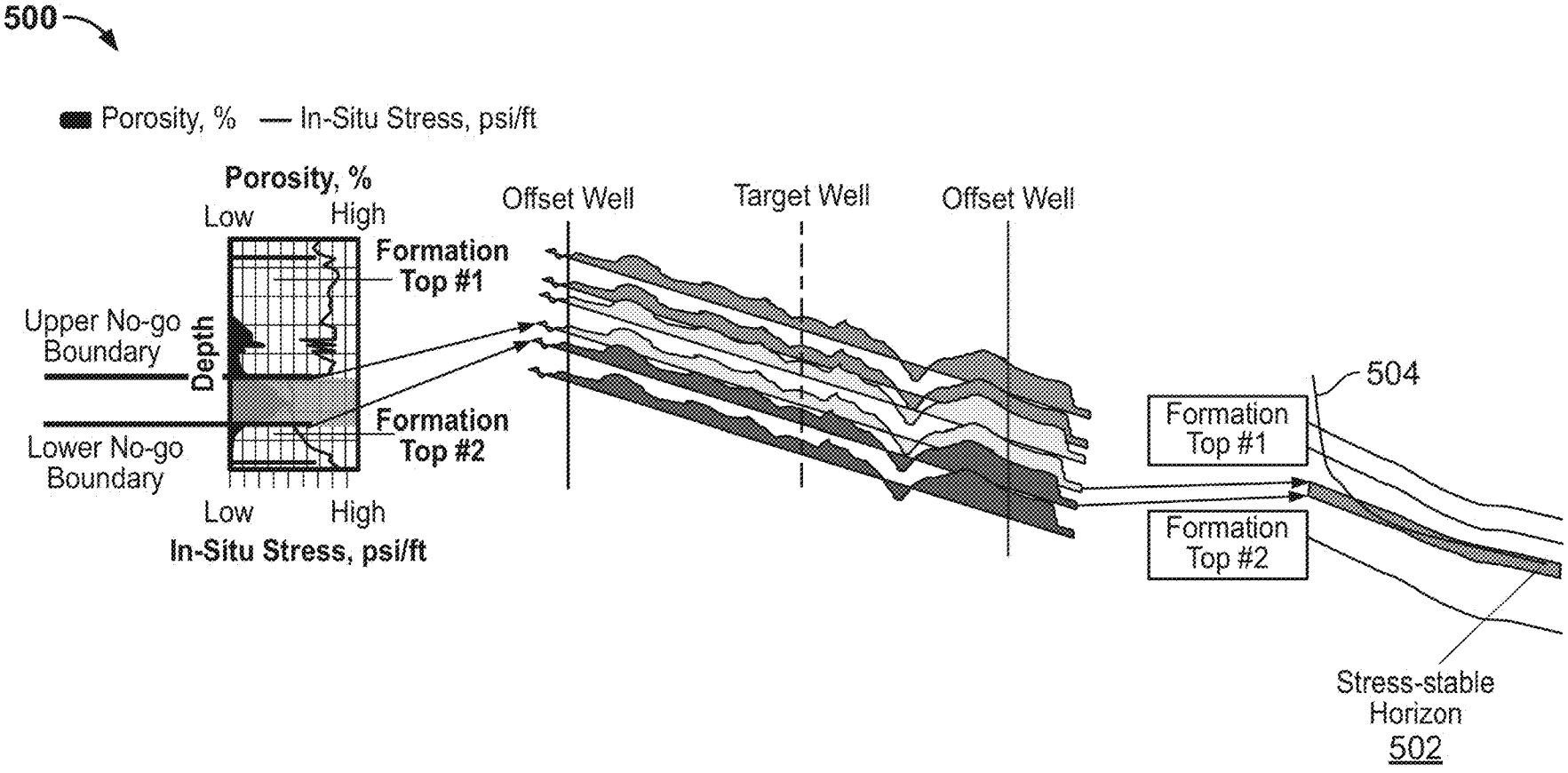
FIG. 5 illustrates an example process of generating a stable-stress horizon, according to some implementations.

FIG. 5 illustrates an example process 500 of generating a stable-stress horizon, according to some implementations. As shown in FIG. 5, the process 500 involves correlating open-hole porosity logs with in-situ stress, identifying a stress-stable window, and marking no-go stress boundaries to identify stable-stress windows. The process 500 then involves integrating the correlated open-hole porosity logs with in-situ stress and 2D seismic data. For example, the thickness of the stable-stress windows is interpolated between the offset wells. Then, the 2D seismic data is used to identify formation dips. The integrated data is used to generate a 3D stable in-situ stress horizon 502. An example drilling trajectory 504 is generated within the in-situ stress horizon 502.

Returning to FIG. 2, at step 228, the computing system 102 determines to proceed the UBCTDD operation to a drilling stage. At step 230, the computing system 102 determines to perform a verification workflow for the stable in-situ stress window. At step 232, the computing system 102 uses the verification workflow to validate the stable in-situ stress window using real-time data. For example, the computing system 102 can perform the validation workflow during the drilling operation. The validation workflow is described in more detail in FIG. 6. At step 234, the computing system 102 completes the drilling total planned depth.

Figure 6:
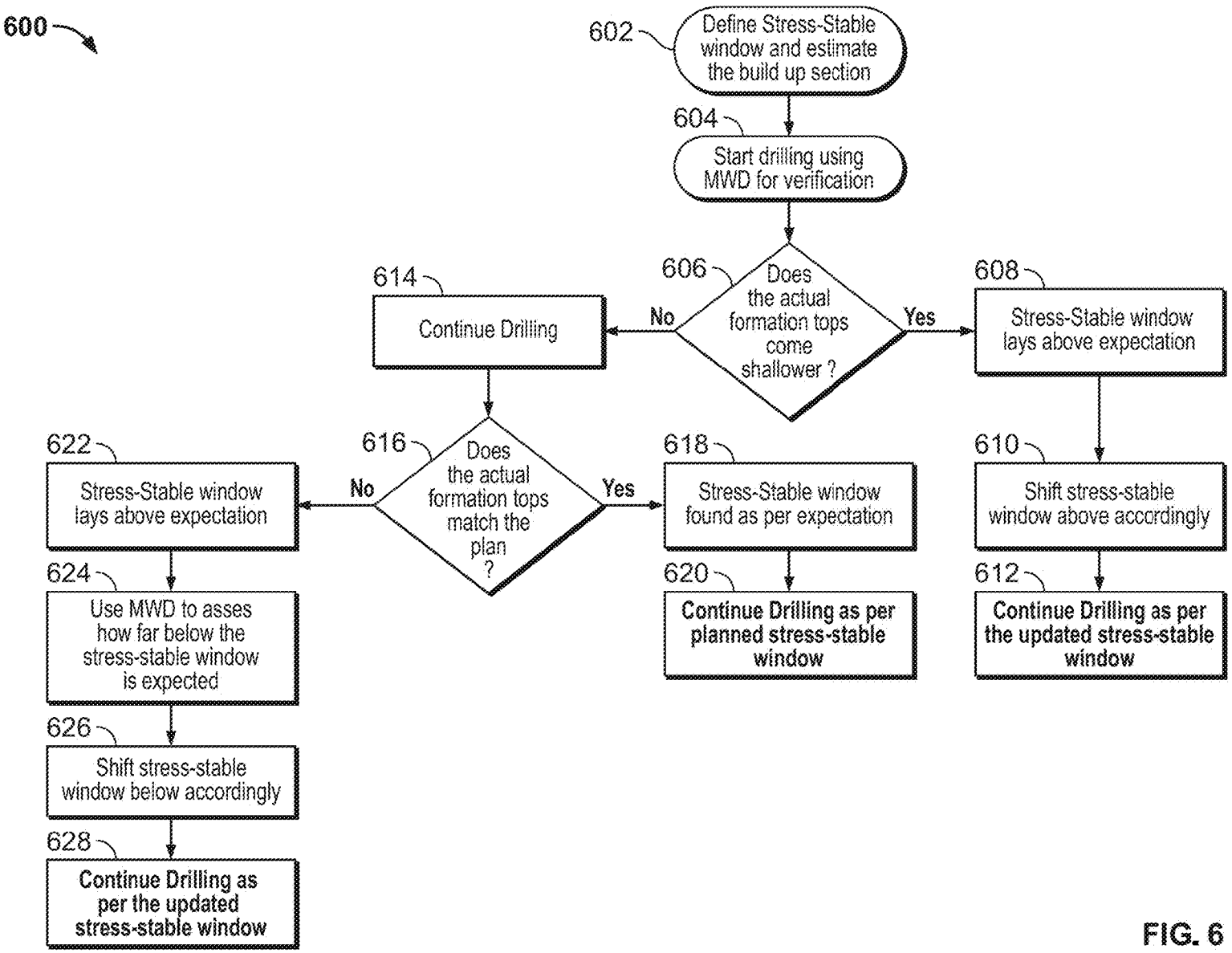
FIG. 6 illustrates an example verification workflow, according to some implementations.

FIG. 6 illustrates an example verification workflow 600, according to some implementations. In some implementations, the verification workflow 600 is performed by the computing system 102 to verify the planned drilling trajectory based on real-time data (e.g., data obtained during the drilling operation).

At step 602, the computing system 102 defines a stress-stable window and estimates a build-up section. The build-up section is the part of the hole where the vertical angle is increased at a certain rate for the lateral to be placed in the target zone. Estimating the build-up section involves estimating how much footage (before drilling) is expected to be drilled prior to landing the horizontal lateral in target. At step 604, the computing system 102 causes the drilling system to start drilling using MWD for verification. At step 606, the computing system 102 determines whether the actual formation tops come shallower than the predicted formation tops. If the answer is yes, the computing system 102 moves to step 608. At step 608, the computing system 102 determines that the stress-stable window is located above the expected location. At step 610, the computing system 102 shifts the stress-stable window above the predicted location. At step 612, the computing system 102 continues drilling per the updated stress-stable window.

Returning to step 606, if the actual formation tops are not shallower than the predicted formation tops, the computing system 102 moves to step 614 of continuing drilling. The computing system 102 then moves to step 616. At step 616, the computing system 102 determines whether the actual formation tops match the predicted formation tops (e.g., within a predetermined threshold of one another). If the actual formation tops match the predicted formation tops, the computing system 102 moves to step 618. At step 618, the computing system 102 determines that the stress-stable window is found per planned trajectory. At step 620, the computing system 102 continues controlling the drilling as per the planned stress-stable window.

Returning to step 616, if the actual formation tops does not match the predicted formation tops, the computing system 102 moves to step 622. At step 622, the computing system 102 determines that the stress-stable window is below the expected location. At step 624, the computing system 102 uses MWD to assess how far below the predicted stress-stable window that the actual stress-stable window is located. At step 626, the computing system 102 shifts the stress-stable window lower based on the assessment. At step 628, the computing system 102 continues controlling the drilling as per the updated stress-stable window.

Figure 7:
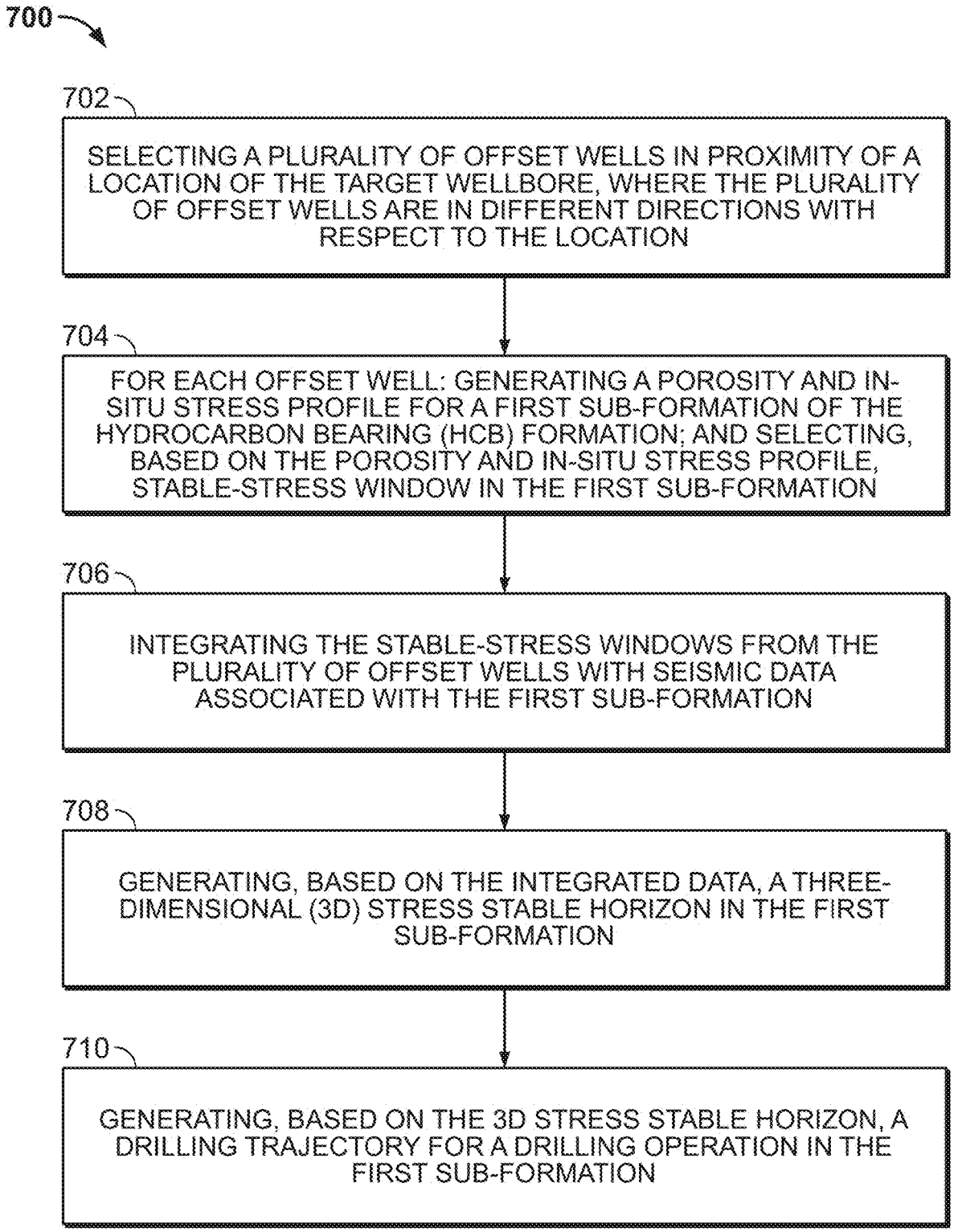
FIG. 7 illustrates a flowchart of an example method, according to some implementations.

FIG. 7 illustrates a flowchart of an example method 700, according to some implementations. For clarity of presentation, the description that follows generally describes method 700 in the context of the other figures in this description. For example, method 700 can be performed by the computing system 102 of FIG. 1. It will be understood that method 700 can be performed, for example, by any suitable system, environment, software, hardware, or a combination of systems, environments, software, and hardware, as appropriate. In some implementations, various steps of method 700 can be run in parallel, in combination, in loops, or in any order. In some implementations, the method 700 is for drilling a target wellbore in a hydrocarbon bearing (HCB) formation.

At step 702, method 700 involves selecting a plurality of offset wells in proximity of a location of the target wellbore, where the plurality of offset wells are in different directions with respect to the location.

At step 704, method 700 involves for each offset well: generating a porosity and in-situ stress profile for a first sub-formation of the HCB formation; and selecting, based on the porosity and in-situ stress profile, stable-stress window in the first sub-formation.

At step 706, method 700 involves integrating the stable-stress windows from the plurality of offset wells with seismic data associated with the first sub-formation.

At step 708, method 700 involves generating, based on the integrated data, a three-dimensional (3D) stress stable horizon in the first sub-formation.

At step 710, method 700 involves generating, based on the 3D stress stable horizon, a drilling trajectory for a drilling operation in the first sub-formation.

In some implementations, the method further involves during the drilling operation, controlling a drilling system to drill according to the drilling trajectory to create the target wellbore.

In some implementations, the method further involves during the drilling operation, using real-time data to verify a predicted location of the 3D stress stable horizon; and in response to determining that the predicted location of the 3D stress stable horizon is inaccurate, adjusting the predicted location of the 3D stress stable horizon based on the real-time data.

In some implementations, the real-time data is measurement-while-drilling (MWD) data.

In some implementations, generating the porosity and in-situ stress profile for the first sub-formation involves defining, using corresponding open-hole logs for the offset wellbore, sub-formation tops for a plurality of sub-formations in the HCB formation; selecting, based on respective porosities of the plurality of sub-formations, the first sub-formation from the plurality of sub-formations; and generating, based on porosity and stress data for the first sub-formation, the porosity and in-situ stress profile for the first sub-formation.

In some implementations, selecting, based on respective porosities of the plurality of sub-formations, the first sub-formation from the plurality of sub-formations involves determining that the respective porosity of the first sub-formation meets a target porosity for the HCB formation.

In some implementations, selecting, based on the porosity and in-situ stress profile, the stable-stress window in the first sub-formation involves identifying, based on the porosity and in-situ stress profile, high-stress contrast regions in the first sub-formation; and defining, based on the high-stress contrast regions, upper and lower boundaries of the stable-stress window.

In some implementations, integrating the stable-stress windows from the plurality of offset wells with the seismic data associated with the first sub-formation involves determining respective thicknesses of the stable-stress windows; interpolating the respective thicknesses of the stable-stress windows between the plurality of offset wells; and tying the interpolated thicknesses with the seismic data to account for formation dipping.

In some implementations, the drilling operation is underbalanced coiled tubing directional drilling (UBCTDD).

Figure 8:
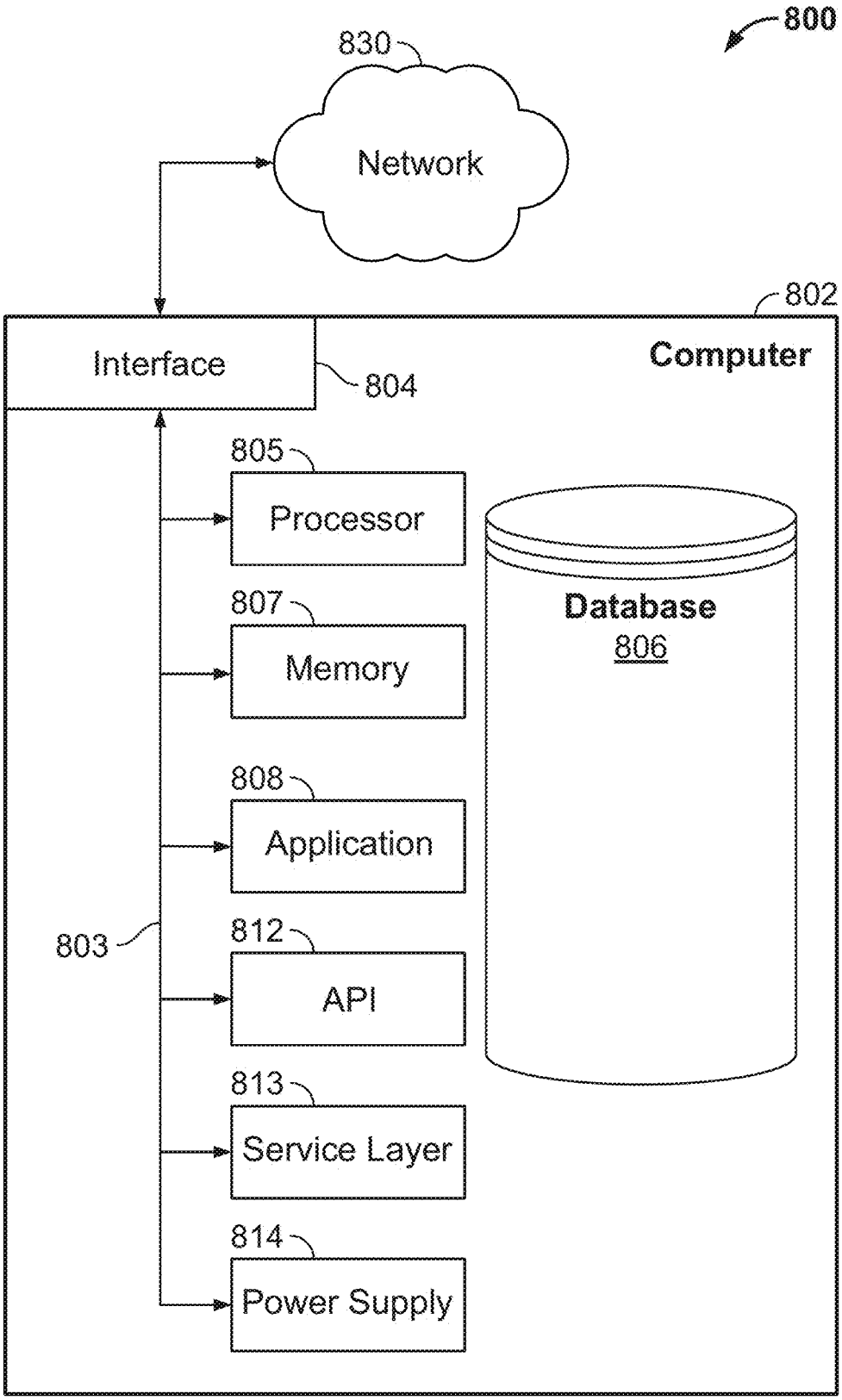
FIG. 8 illustrates a block diagram of an example computer system, according to some implementations.

FIG. 8 is a block diagram of an example computer system 800 that can be used to provide computational functionalities associated with described algorithms, methods, functions, processes, flows, and procedures, according to some implementations of the present disclosure. In some implementations, the computing system 102 can be the computer system 800, include the computer system 800, or the computing system 102 can communicate with the computer system 800.

The illustrated computer 802 is intended to encompass any computing device such as a server, a desktop computer, an embedded computer, a laptop/notebook computer, a wireless data port, a smart phone, a personal data assistant (PDA), a tablet computing device, or one or more processors within these devices, including physical instances, virtual instances, or both. The computer 802 can include input devices such as keypads, keyboards, and touch screens that can accept user information. Also, the computer 802 can include output devices that can convey information associated with the operation of the computer 802. The information can include digital data, visual data, audio information, or a combination of information. The information can be presented in a graphical user interface (UI) (or GUI). In some implementations, the inputs and outputs include display ports (such as DVI-I+2x display ports), USB 3.0, GbE ports, isolated DI/O, SATA-III (6.0 Gb/s) ports, mPCIe slots, a combination of these, or other ports. In instances of an edge gateway, the computer 802 can include a Smart Embedded Management Agent (SEMA), such as a built-in ADLINK SEMA 2.2, and a video sync technology, such as Quick Sync Video technology supported by ADLINK MSDK+. In some examples, the computer 802 can include the MXE-5400 Series processor-based fanless embedded computer by ADLINK, though the computer 802 can take other forms or include other components.

The computer 802 can serve in a role as a client, a network component, a server, a database, a persistency, or components of a computer system for performing the subject matter described in the present disclosure. The illustrated computer 802 is communicably coupled with a network 830. In some implementations, one or more components of the computer 802 can be configured to operate within different environments, including cloud-computing-based environments, local environments, global environments, and combinations of environments.

At a high level, the computer 802 is an electronic computing device operable to receive, transmit, process, store, and manage data and information associated with the described subject matter. According to some implementations, the computer 802 can also include, or be communicably coupled with, an application server, an email server, a web server, a caching server, a streaming data server, or a combination of servers.

The computer 802 can receive requests over network 830 from a client application (for example, executing on another computer 802). The computer 802 can respond to the received requests by processing the received requests using software applications. Requests can also be sent to the computer 802 from internal users (for example, from a command console), external (or third) parties, automated applications, entities, individuals, systems, and computers.

Each of the components of the computer 802 can communicate using a system bus 803. In some implementations, any or all of the components of the computer 802, including hardware or software components, can interface with each other or the interface 804 (or a combination of both), over the system bus. Interfaces can use an application programming interface (API) 812, a service layer 813, or a combination of the API 812 and service layer 813. The API 812 can include specifications for routines, data structures, and object classes. The API 812 can be either computer-language independent or dependent. The API 812 can refer to a complete interface, a single function, or a set of APIs 812.

The service layer 813 can provide software services to the computer 802 and other components (whether illustrated or not) that are communicably coupled to the computer 802. The functionality of the computer 802 can be accessible for all service consumers using this service layer 813. Software services, such as those provided by the service layer 813, can provide reusable, defined functionalities through a defined interface. For example, the interface can be software written in JAVA, C++, or a language providing data in extensible markup language (XML) format. While illustrated as an integrated component of the computer 802, in alternative implementations, the API 812 or the service layer 813 can be stand-alone components in relation to other components of the computer 802 and other components communicably coupled to the computer 802. Moreover, any or all parts of the API 812 or the service layer 813 can be implemented as child or sub-modules of another software module, enterprise application, or hardware module without departing from the scope of the present disclosure.

The computer 802 can include an interface 804. Although illustrated as a single interface 804 in FIG. 8, two or more interfaces 804 can be used according to particular needs, desires, or particular implementations of the computer 802 and the described functionality. The interface 804 can be used by the computer 802 for communicating with other systems that are connected to the network 830 (whether illustrated or not) in a distributed environment. Generally, the interface 804 can include, or be implemented using, logic encoded in software or hardware (or a combination of software and hardware) operable to communicate with the network 830. More specifically, the interface 804 can include software supporting one or more communication protocols associated with communications. As such, the network 830 or the interface's hardware can be operable to communicate physical signals within and outside of the illustrated computer 802.

The computer 802 includes a processor 805. Although illustrated as a single processor 805 in FIG. 8, two or more processors 805 can be used according to particular needs, desires, or particular implementations of the computer 802 and the described functionality. Generally, the processor 805 can execute instructions and manipulate data to perform the operations of the computer 802, including operations using algorithms, methods, functions, processes, flows, and procedures as described in the present disclosure.

The computer 802 can also include a database 806 that can hold data for the computer 802 and other components connected to the network 830 (whether illustrated or not). For example, database 806 can be an in-memory, conventional, or a database storing data consistent with the present disclosure. In some implementations, the database 806 can be a combination of two or more different database types (for example, hybrid in-memory and conventional databases) according to particular needs, desires, or particular implementations of the computer 802 and the described functionality. Although illustrated as a single database 806 in FIG. 8, two or more databases (of the same, different, or combination of types) can be used according to particular needs, desires, or particular implementations of the computer 802 and the described functionality. While database 806 is illustrated as an internal component of the computer 802, in alternative implementations, database 806 can be external to the computer 802.

The computer 802 also includes a memory 807 that can hold data for the computer 802 or a combination of components connected to the network 830 (whether illustrated or not). Memory 807 can store any data consistent with the present disclosure. In some implementations, memory 807 can be a combination of two or more different types of memory (for example, a combination of semiconductor and magnetic storage) according to particular needs, desires, or particular implementations of the computer 802 and the described functionality. Although illustrated as a single memory 807 in FIG. 8, two or more memories 807 (of the same, different, or combination of types) can be used according to particular needs, desires, or particular implementations of the computer 802 and the described functionality. While memory 807 is illustrated as an internal component of the computer 802, in alternative implementations, memory 807 can be external to the computer 802.

An application 808 can be an algorithmic software engine providing functionality according to particular needs, desires, or particular implementations of the computer 802 and the described functionality. For example, an application 808 can serve as one or more components, modules, or applications 808. Multiple applications 808 can be implemented on the computer 802. Each application 808 can be internal or external to the computer 802.

The computer 802 can also include a power supply 814. The power supply 814 can include a rechargeable or non-rechargeable battery that can be configured to be either user- or non-user-replaceable. In some implementations, the power supply 814 can include power-conversion and management circuits, including recharging, standby, and power management functionalities. In some implementations, the power-supply 814 can include a power plug to allow the computer 802 to be plugged into a wall socket or a power source to, for example, power the computer 802 or recharge a rechargeable battery.

There can be any number of computers 802 associated with, or external to, a computer system including computer 802, with each computer 802 communicating over network 830. Further, the terms "client," "user," and other appropriate terminology can be used interchangeably without departing from the scope of the present disclosure. Moreover, the present disclosure contemplates that many users can use one computer 802 and one user can use multiple computers 802.

Implementations of the subject matter and the functional operations described in this specification can be implemented in digital electronic circuitry, in tangibly embodied computer software or firmware; in computer hardware, including the structures disclosed in this specification and their structural equivalents; or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal. For example, the signal can be a machine-generated electrical, optical, or electromagnetic signal that is generated to encode information for transmission to a suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatuses, devices, and machines for processing data, including by way of example, a programmable processor, a computer, or multiple processors or computers. The apparatus can also include special purpose logic circuitry including, for example, a central processing unit (CPU), a field programmable gate array (FPGA), or an application specific integrated circuit (ASIC). In some implementations, the data processing apparatus or special purpose logic circuitry (or a combination of the data processing apparatus and special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, for example, Linux, Unix, Windows, Mac OS, Android, or iOS.

A computer program, which can also be referred to or described as a program, software, a software application, a module, a software module, a script, or code can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document; in a single file dedicated to the program in question; or in multiple coordinated files storing one or more modules, sub programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes; the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory. A computer can also include, or be operatively coupled to, one or more mass storage devices for storing data. In some implementations, a computer can receive data from, and transfer data to, the mass storage devices including, for example, magnetic, magneto optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer readable media (transitory or non-transitory, as appropriate) suitable for storing computer program instructions and data can include all forms of permanent/non-permanent and volatile/non-volatile memory, media, and memory devices. Computer readable media can include, for example, semiconductor memory devices such as random-access memory (RAM), read only memory (ROM), phase change memory (PRAM), static random-access memory (SRAM), dynamic random access memory (DRAM), erasable programmable read-only memory (EPROM), electrically erasable programmable read-only memory (EEPROM), and flash memory devices. Computer readable media can also include, for example, magnetic devices such as tape, cartridges, cassettes, and internal/removable disks. Computer readable media can also include magneto optical disks, optical memory devices, and technologies including, for example, digital video disc (DVD), CD ROM, DVD+/-R, DVD-RAM, DVD-ROM, HD-DVD, and BLURAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated in, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), or a plasma monitor. Display devices can include a keyboard and pointing devices including, for example, a mouse, a trackball, or a trackpad. User input can also be provided to the computer using a touchscreen, such as a tablet computer surface with pressure sensitivity or a multi-touch screen using capacitive or electric sensing. Other kinds of devices can be used to provide for interaction with a user, including to receive user feedback, for example, sensory feedback including visual feedback, auditory feedback, or tactile feedback. Input from the user can be received in the form of acoustic, speech, or tactile input. In addition, a computer can interact with a user by sending documents to, and receiving documents from, a device that is used by the user. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back-end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

Figure 9:
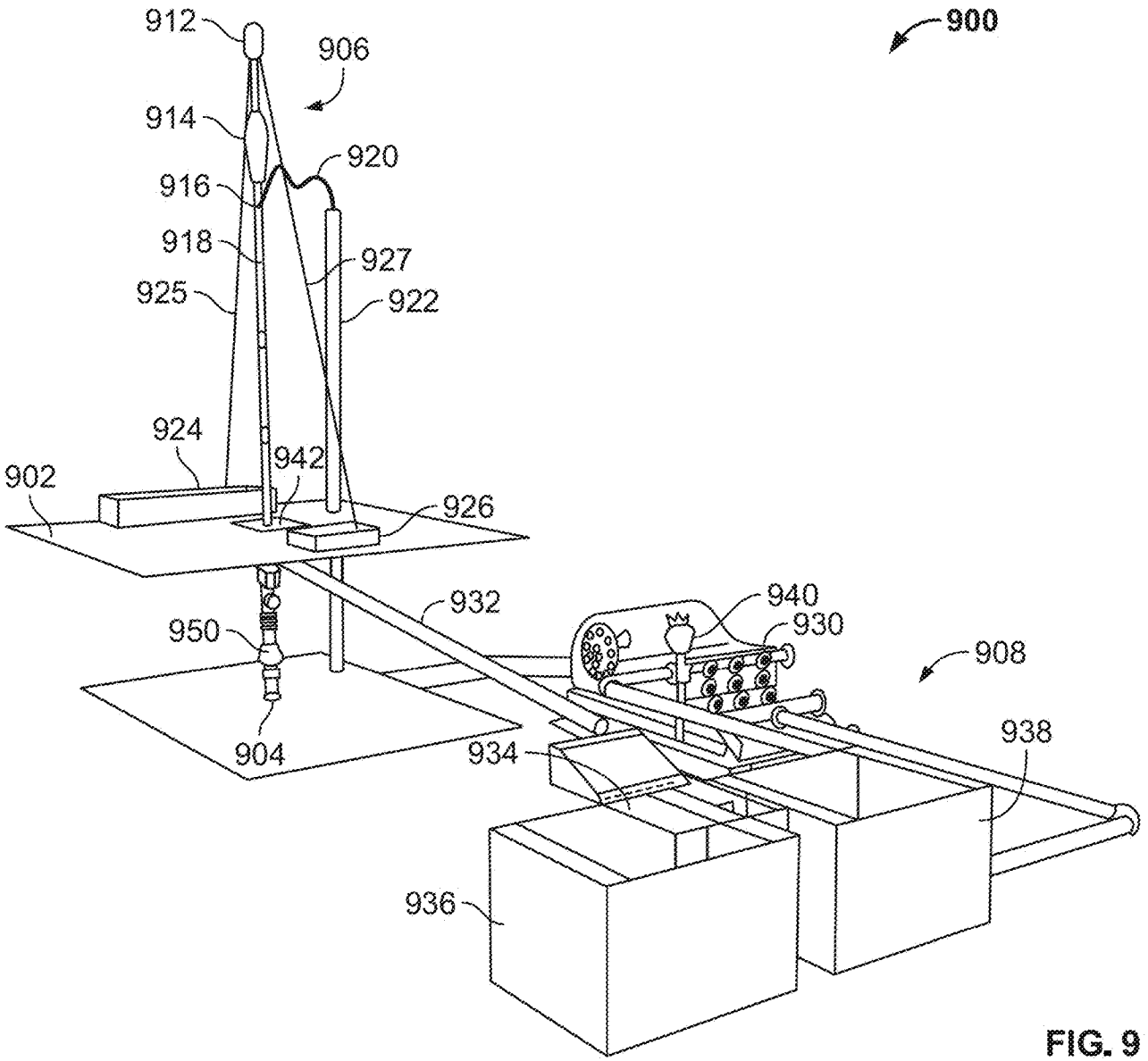
FIG. 9 illustrates a partial schematic perspective view of an example rig system for drilling and producing a well, according to some implementations.

FIG. 9 is a partial schematic perspective view of an example rig system 900 for drilling and producing a well. The well can extend from the surface through the Earth to one or more subterranean zones of interest. The example rig system 900 includes a drill floor 902 positioned above the surface, a wellhead 904, a drill string assembly 906 supported by the rig structure, a fluid circulation system 908 to filter used drilling fluid from the wellbore and provide clean drilling fluid to the drill string assembly 906. For example, the example rig system 900 of FIG. 9 is shown as a drill rig capable of performing a drilling operation with the rig system 900 supporting the drill string assembly 906 over a wellbore. The wellhead 904 can be used to support casing or other well components or equipment into the wellbore of the well.

The derrick or mast is a support framework mounted on the drill floor 902 and positioned over the wellbore to support the components of the drill string assembly 906 during drilling operations. A crown block 912 forms a longitudinally-fixed top of the derrick, and connects to a travelling block 914 with a drilling line including a set of wire ropes or cables. The crown block 912 and the travelling block 914 support the drill string assembly 906 via a swivel 916, a kelly 918, or a top drive system (not shown). Longitudinal movement of the travelling block 914 relative to the crown block 912 of the drill string assembly 906 acts to move the drill string assembly 906 longitudinally upward and downward. The swivel 916, connected to and hung by the travelling block 914 and a rotary hook, allows free rotation of the drill string assembly 906 and provides a connection to a kelly hose 920, which is a hose that flows drilling fluid from a drilling fluid supply of the circulation system 908 to the drill string assembly 906. A standpipe 922 mounted on the drill floor 902 guides at least a portion of the kelly hose 920 to a location proximate to the drill string assembly 906. The kelly 918 is a hexagonal device suspended from the swivel 916 and connected to a longitudinal top of the drill string assembly 906, and the kelly 918 turns with the drill string assembly 906 as the rotary table 942 of the drill string assembly turns.

In the example rig system 900 of FIG. 9, the drill string assembly 906 is made up of drill pipes with a drill bit (not shown) at a longitudinally bottom end of the drill string. The drill string assembly 906 is described in more detail later, and a more detailed view is shown in FIG. 2. The drill pipe can include hollow steel piping, and the drill bit can include cutting tools, such as blades, discs, rollers, cutters, or a combination of these, to cut into the formation and form the wellbore. The drill bit rotates and penetrates through rock formations below the surface under the combined effect of axial load and rotation of the drill string assembly 906. In some implementations, the kelly 918 and swivel 916 can be replaced by a top drive that allows the drill string assembly 906 to spin and drill. The wellhead assembly 904 can also include a drawworks 924 and a deadline anchor 926, where the drawworks 924 includes a winch that acts as a hoisting system to reel the drilling line in and out to raise and lower the drill string assembly 906 by a fast line 925. The deadline anchor 926 fixes the drilling line opposite the drawworks 924 by a deadline 927, and can measure the suspended load (or hook load) on the rotary hook. The weight on bit (WOB) can be measured when the drill bit is at the bottom the wellbore. The wellhead assembly 904 also includes a blowout preventer 950 positioned at the surface of the well and below (but often connected to) the drill floor 902. The blowout preventer 950 acts to prevent well blowouts caused by formation fluid entering the wellbore, displacing drilling fluid, and flowing to the surface at a pressure greater than atmospheric pressure. The blowout preventer 950 can close around (and in some instances, through) the drill string assembly 906 and seal off the space between the drill string and the wellbore wall. The blowout preventer 950 is described in more detail later.

During a drilling operation of the well, the circulation system 908 circulates drilling fluid from the wellbore to the drill string assembly 906, filters used drilling fluid from the wellbore, and provides clean drilling fluid to the drill string assembly 906. The example circulation system 908 includes a fluid pump 930 that fluidly connects to and provides drilling fluid to drill string assembly 906 via the kelly hose 920 and the standpipe 922. The circulation system 908 also includes a flow-out line 932, a shale shaker 934, a settling pit 936, and a suction pit 938. In a drilling operation, the circulation system 908 pumps drilling fluid from the surface, through the drill string assembly 906, out the drill bit and back up the annulus of the wellbore, where the annulus is the space between the drill pipe and the formation or casing. The density of the drilling fluid is intended to be greater than the formation pressures to prevent formation fluids from entering the annulus and flowing to the surface and less than the mechanical strength of the formation, as a greater density may fracture the formation, thereby creating a path for the drilling fluids to go into the formation. Apart from well control, drilling fluids can also cool the drill bit and lift rock cuttings from the drilled formation up the annulus and to the surface to be filtered out and treated before it is pumped down the drill string assembly 906 again. The drilling fluid returns in the annulus with rock cuttings and flows out to the flow-out line 932, which connects to and provides the fluid to the shale shaker 934. The flow line is an inclined pipe that directs the drilling fluid from the annulus to the shale shaker 934. The shale shaker 934 includes a mesh-like surface to separate the coarse rock cuttings from the drilling fluid, and finer rock cuttings and drilling fluid then go through the settling pit 936 to the suction pit 936. The circulation system 908 includes a mud hopper 940 into which materials (for example, to provide dispersion, rapid hydration, and uniform mixing) can be introduced to the circulation system 908. The fluid pump 930 cycles the drilling fluid up the standpipe 922 through the swivel 916 and back into the drill string assembly 906 to go back into the well.

The example wellhead assembly 904 can take a variety of forms and include a number of different components. For example, the wellhead assembly 904 can include additional or different components than the example shown in FIG. 9. Similarly, the circulation system 908 can include additional or different components than the example shown in FIG. 9.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, or in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations; and the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

What is claimed is:

1. A method for drilling a target wellbore in a hydrocarbon bearing (HCB) formation, the method comprising:

selecting a plurality of offset wells in proximity of a location of the target wellbore, wherein the plurality of offset wells comprise at least three offset wells that are in different directions within a distance from the location predicted for the target wellbore;

for each offset well of the plurality of offset wells:

generating a porosity and in-situ stress profile for a first sub-formation of the HCB formation; and selecting, based on the porosity and in-situ stress profile, stable-stress window in the first sub-formation;

integrating the stable-stress windows from the plurality of offset wells with seismic data associated with the first sub-formation to generate integrated data;

generating, based on the integrated data, a three-dimensional (3D) stress stable horizon in the first sub-formation;

generating, based on the 3D stress stable horizon, a drilling trajectory for a drilling operation in the first sub-formation; and during the drilling operation, controlling a drilling system to drill according to the drilling trajectory to create the target wellbore.

2. The method of claim 1, wherein selecting the stable-stress window in the first sub-formation further comprises: estimating a build-up section comprising a vertical angle increased at a rate for the lateral to be placed in a target zone.

3. The method of claim 2, further comprising:

during the drilling operation, using real-time data to verify a predicted location of the 3D stress stable horizon; and in response to determining that the predicted location of the 3D stress stable horizon is inaccurate, adjusting the predicted location of the 3D stress stable horizon based on the real-time data.

4. The method of claim 3, wherein the real-time data is measurement-while-drilling (MWD) data.

5. The method of claim 1, wherein generating the porosity and in-situ stress profile for the first sub-formation comprises:

defining, using corresponding open-hole logs for a respective offset wellbore, sub-formation tops for a plurality of sub-formations in the HCB formation;

selecting, based on respective porosities of the plurality of sub-formations, the first sub-formation from the plurality of sub-formations; and generating, based on porosity and stress data for the first sub-formation, the porosity and in-situ stress profile for the first sub-formation.

6. The method of claim 5, wherein selecting, based on respective porosities of the plurality of sub-formations, the first sub-formation from the plurality of sub-formations comprises:

determining that the respective porosity of the first sub-formation meets a target porosity for the HCB formation.

7. The method of claim 1, wherein selecting, based on the porosity and in-situ stress profile, the stable-stress window in the first sub-formation comprises:

identifying, based on the porosity and in-situ stress profile, high-stress contrast regions in the first sub-formation; and defining, based on the high-stress contrast regions, upper and lower boundaries of the stable-stress window.

8. The method of claim 1, wherein integrating the stable-stress windows from the plurality of offset wells with the seismic data associated with the first sub-formation comprises:

determining respective thicknesses of the stable-stress windows;

interpolating the respective thicknesses of the stable-stress windows between the plurality of offset wells to generate interpolated thicknesses; and tying the interpolated thicknesses with the seismic data to account for formation dipping.

9. The method of claim 1, wherein the drilling operation is underbalanced coiled tubing directional drilling (UB-CTDD).

10. A system for drilling a target wellbore in a hydrocarbon bearing (HCB) formation, the system comprising:

one or more processors configured to perform operations comprising:

selecting a plurality of offset wells in proximity of a location of the target wellbore, wherein the plurality of offset wells comprise at least three offset wells that are in different directions within a distance from the location predicted for the target wellbore;

for each offset well of the plurality of offset wells:

generating a porosity and in-situ stress profile for a first sub-formation of the HCB formation; and selecting, based on the porosity and in-situ stress profile, stable-stress window in the first sub-formation;

integrating the stable-stress windows from the plurality of offset wells with seismic data associated with the first sub-formation to generate integrated data;

generating, based on the integrated data, a three-dimensional (3D) stress stable horizon in the first sub-formation;

generating, based on the 3D stress stable horizon, a drilling trajectory for a drilling operation in the first sub-formation; and during the drilling operation, controlling a drilling system to drill according to the drilling trajectory to create the target wellbore.

11. The system of claim 10, wherein selecting the stable-stress window in the first sub-formation further comprises: estimating a build-up section comprising a vertical angle increased at a rate for the lateral to be placed in a target zone.

12. The system of claim 11, the operations further comprising:

during the drilling operation, using real-time data to verify a predicted location of the 3D stress stable horizon; and in response to determining that the predicted location of the 3D stress stable horizon is inaccurate, adjusting the predicted location of the 3D stress stable horizon based on the real-time data.

13. The system of claim 12, wherein the real-time data is measurement-while-drilling (MWD) data.

14. The system of claim 10, wherein generating the porosity and in-situ stress profile for the first sub-formation comprises:

defining, using corresponding open-hole logs for a respective offset wellbore, sub-formation tops for a plurality of sub-formations in the HCB formation;

selecting, based on respective porosities of the plurality of sub-formations, the first sub-formation from the plurality of sub-formations; and generating, based on porosity and stress data for the first sub-formation, the porosity and in-situ stress profile for the first sub-formation.

15. The system of claim 14, wherein selecting, based on respective porosities of the plurality of sub-formations, the first sub-formation from the plurality of sub-formations comprises:

determining that the respective porosity of the first sub-formation meets a target porosity for the HCB formation.

16. The system of claim 10, wherein selecting, based on the porosity and in-situ stress profile, the stable-stress window in the first sub-formation comprises:

identifying, based on the porosity and in-situ stress profile, high-stress contrast regions in the first sub-formation; and defining, based on the high-stress contrast regions, upper and lower boundaries of the stable-stress window.

17. The system of claim 10, wherein integrating the stable-stress windows from the plurality of offset wells with the seismic data associated with the first sub-formation comprises:

determining respective thicknesses of the stable-stress windows;

interpolating the respective thicknesses of the stable-stress windows between the plurality of offset wells to generate interpolated thicknesses; and tying the interpolated thicknesses with the seismic data to account for formation dipping.

18. The system of claim 10, wherein the drilling operation is underbalanced coiled tubing directional drilling (UB-CTDD).

19. A non-transitory computer storage medium encoded with instructions that, when executed by one or more computers, cause the one or more computers to perform operations for drilling a target wellbore in a hydrocarbon bearing (HCB) formation, the operations comprising:

selecting a plurality of offset wells in proximity of a location of the target wellbore, wherein the plurality of offset wells comprise at least three offset wells that are in different directions within a distance from the location predicted for the target wellbore;

for each offset well of the plurality of offset wells:

generating a porosity and in-situ stress profile for a first sub-formation of the HCB formation; and selecting, based on the porosity and in-situ stress profile, stable-stress window in the first sub-formation;

integrating the stable-stress windows from the plurality of offset wells with seismic data associated with the first sub-formation to generate integrated data;

generating, based on the integrated data, a three-dimensional (3D) stress stable horizon in the first sub-formation;

generating, based on the 3D stress stable horizon, a drilling trajectory for a drilling operation in the first sub-formation; and during the drilling operation, controlling a drilling system to drill according to the drilling trajectory to create the target wellbore.

20. The non-transitory computer storage medium of claim 19, wherein selecting the stable-stress window in the first sub-formation further comprises: estimating a build-up section comprising a vertical angle increased at a rate for the lateral to be placed in a target zone.

* * * * *